US007062061B2

(12) United States Patent
Suzuki

(10) Patent No.: US 7,062,061 B2
(45) Date of Patent: Jun. 13, 2006

(54) SPEAKER APPARATUS

(75) Inventor: Takashi Suzuki, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 266 days.

(21) Appl. No.: 10/814,643

(22) Filed: Apr. 1, 2004

(65) Prior Publication Data

US 2004/0197004 A1 Oct. 7, 2004

(30) Foreign Application Priority Data

Apr. 4, 2003 (JP) ..... P2003-101182

(51) Int. Cl.
*H04R 25/00* (2006.01)

(52) U.S. Cl. ..... 381/409; 381/408; 381/410

(58) Field of Classification Search ..... 381/400, 381/403, 407–411
See application file for complete search history.

(56) References Cited

U.S. PATENT DOCUMENTS

| | | | | |
|---|---|---|---|---|
| 4,088,847 | A * | 5/1978 | Yukimoto et al. | 381/410 |
| 4,225,756 | A * | 9/1980 | Babb | 381/407 |
| 4,539,442 | A * | 9/1985 | Puls et al. | 381/409 |
| 5,937,076 | A * | 8/1999 | Tanabe et al. | 381/409 |
| 6,587,571 | B1 * | 7/2003 | Fujihira et al. | 381/407 |

FOREIGN PATENT DOCUMENTS

| | | |
|---|---|---|
| JP | 5-183993 A | 7/1993 |
| JP | 7-15795 A | 1/1995 |
| JP | 2002-125294 A | 4/2002 |

* cited by examiner

*Primary Examiner*—Suhan Ni
(74) *Attorney, Agent, or Firm*—Sughrue Mion, PLLC

(57) ABSTRACT

Supplemental portions are added to lead portions of a voice coil attached to a coil bobbin. The supplemental portions each has a shape, which can be restored repeatedly in response to stress, applied to the lead portions. In the case where stress is exerted on the lead portions under the influence of the pulling stress and compressive stress produced in the winding portion when a large driving current is supplied to the voice coil, the supplemental portions are deformed, thereby preventing the wire breaking at the lead portions.

6 Claims, 4 Drawing Sheets

SPEAKER APPARATUS

BACKGROUND OF THE INVENTION

1. Field of the Invention

This invention relates to a speaker apparatus.

2. Description of the Related Art

A speaker apparatus in "a moving coil system", which has been widely known, is shown in FIGS. 1 and 2.

As seen from FIG. 1, a speaker apparatus 100 has a magnetic circuit 104 which includes a yoke 101 equipped with a center pole made of a magnetic material, a ring-shaped magnet 102 arranged on the outer periphery of the yoke 101 and a ring-shaped plate 103 arranged on the magnet 102.

The magnetic circuit 104 has a magnetic gap 104*a* formed between the inner peripheral surface of the plate 103 and the outer peripheral surface of a protrusion 101*a* provided at the center of the yoke 101.

Further, the speaker apparatus 100 also includes a cylindrical coil bobbin 105 made of a non-magnetic material and a voice coil 106 attached thereto.

The one end of the coil bobbin 105 is fixedly coupled with the outer periphery of a central hole of a diaphragm 107 having a conical shape. The other end of the coil bobbin 105 is arranged within the magnetic gap 104*a*.

The voice coil 106 includes a winding portion 106*a* where a conductive wire is wound on the outer peripheral surface of the coil bobbin 105 and lead portions 106*b* where a conductive wires at each of both ends of the winding portion 106*a* is extracted unidirectionally along the outer peripheral surface of the coil bobbin 105. Each of the lead portions 106*b* is extracted to the main surface of the diaphragm 107 and connected to an electric supply line 108.

As seen from FIG. 2, in the lead portions 106*b* of the voice coil 106, the conductive wire at each of at both ends of the winding portion 106*a* of the voice coil 106 are extracted along the peripheral surface of the coil bobbin 105 in a direction of attaching the diaphragm 107. The lead portions 106*b* are fixed to the coil bobbin 105 by a winding tape 114 wound on the coil bobbin 105.

Returning to FIG. 1, the central hole of the diaphragm 107 is covered with a cap 109. The diaphragm 107 is attached to a frame 112 through edges 110 and dampers 111 which are made of an elastic material and have an elastic shape.

The frame 112 is provided to a pair of input terminals 113 (only one thereof is illustrated) for supplying an electric signal to the voice coil 106. These pair of input terminals 113 each is connected to the other end of the electric supply line 108 connected to the lead portion 106*b*.

In the speaker apparatus 100 having the configuration described above, when a driving current is supplied to the voice coil 106 through the input terminal 113, the voice coil 106 oscillates in an axial direction of the coil bobbin 105 (in the direction of Y—Y line in FIG. 2) owing to the electromagnetic force which is generated between itself and the magnetic field applied by the magnetic circuit 104.

At this time, since the voice coil 106 is coupled with the diaphragm 107 through the coil bobbin 105, the diaphragm 107 also oscillates owing to the oscillation generated in the voice coil 106. Thus, an acoustic energy (voice) according to the driving current is output from the speaker apparatus 100.

Meanwhile, in order that a loud volume of sound is produced from the speaker apparatus 100, it is necessary to supply a large current to the voice coil 106 to oscillate the diaphragm 107 severely. However, if the current supplied to the voice coil 106 is increased, not only the driving force to drive the diaphragm 107 but also the pulling stress and compressive stress applied to the winding portion 106*a* of the voice coil 106 will be increased.

In this case, owing to the stress generated in the winding portion 106*a*, the coil bobbin 105 is also subjected to deformation and oscillation etc. As a result, the lead portions 106*b* fixed to the coil bobbin 105 may suffer from unexpected stress so that it is broken.

In order to overcome such an inconvenience, a proposed method (hereinafter referred to the first method) for preventing the lead portions from breaking is to attach a streamlined wire with a tin (Sn)-plated layer on the surface to the coil bobbin and welding-couple the lead portions extracted from the voice coil with the streamlined wire (refer to JP-A-5-183993).

Another proposed method (hereinafter referred to as the second method) is to cover the lead portions extracted above a damper for supporting the coil bobbin with a sealing member of foamed hot-melt (refer to JP-A-7-015795).

A still another proposed method (hereinafter referred to the third method) is to connect the lead wire extracted from the voice coil to a speaker-dedicated lead wire on the periphery of the coil bobbin using caulking metal fittings (refer to JP-A-2002-125294).

SUMMARY OF THE INVENTION

However, the first to third methods have such disadvantages that they must be equipped with such new members as the streamlined wire, sealing member, and caulking metal fittings and speaker-dedicated wire, respectively.

Therefore, an increase in the cost taken for these members, production cost due to the complication of the manufacturing process, etc. results in increased total cost.

Further, attachment of new members to the coil bobbin and damper increases the weight of the portion, which oscillates together with the diaphragm. This led to a problem that the sound quality deteriorates and the power efficiency of the voice for the inputted driving current attenuates.

The breaking of the lead portions generated when a large current is supplied, as described above, is mainly attributable to the deformation and oscillation of the coil bobbin attendant on those of the voice coil. Therefore, the breaking occurs most frequently in the vicinity of the voice coil. However, both the second and third methods take a countermeasure at a position apart from the voice coil and hence are difficult to prevent the breaking of the lead portions completely.

The first method takes the countermeasure at a position relatively near to the voice coil and so can provide a sufficient strength of connecting the lead wire and streamlined wire and a sufficient mechanical strength.

However, since a positional relationship between the extracting portion (lead portion) of the conductive wire at the voice coil and the connecting portion of connecting the lead portion and streamlined wire is fixed, it is apparent that the first method cannot provide a sufficiently effective countermeasure from the standpoint of carrying away the stress applied to the lead portion owing to the deformation and oscillation generated in the coil bobbin.

The fourth method for preventing the breaking of the lead portion is to increase the diameter of the conductive wire used for the voice coil sufficiently to increase the mechanical strength of the conductive wire at the lead portion.

However, using the conductive wire having a large diameter drastically increases the weight of the voice coil. This gives rise to a problem that the deterioration of the sound quality and the attenuation of the power efficiency become conspicuous. Further, using the conductive wire having the large diameter occurs a problem of increasing the volume of the voice coil, which leads to the large-scaling of the whole speaker apparatus.

Particularly, in the case of a "vehicle-mounted speaker" apparatus, which is mounted on a vehicle such as a motor car, the speaker apparatus is required to reduce in weight and size sufficiently in view of the circumstances that the fuel efficiency deteriorates with an increase in the weight of the apparatus mounted on the vehicle and the size of the speaker apparatus is limited in order to assure the sufficient space within the vehicle.

Thus, the fourth method is also difficult to be applied to the vehicle-mounted speaker.

Further, among vehicle-mounted speakers, the speaker apparatus for woofer or sub-woofer which deals with the voice output in a bass range is required to deal with a larger output than in a usual speaker apparatus in order that the voice in the bass range is sufficiently audible even when the running noise of the vehicle generated in the bass range is superposed on the voice.

Therefore, the stress applied to the lead portion is also large. This makes it more important to prevent the breaking of the lead portion.

One of the problems to be solved by the present invention is that the number of components of the speaker apparatus is increased for preventing the breaking of the lead wire, which occurred in the prior arts described above.

The speaker apparatus described in claim 1 of this invention comprises a magnetic circuit having a magnetic gap, a magnetic field generating portion for generating a magnetic field to be applied to the magnetic circuit, a cylindrical coil bobbin arranged within the magnetic gap, a voice coil including a winding portion where a conductive wire is wound circumferentially on the periphery of the coil bobbin and lead portions where the conductive wire at each of both ends of the winding portion is extracted unidirectionally along the periphery of the coil bobbin, a diaphragm coupled with the one end of the coil bobbin and being oscillatable in an axial direction of the coil bobbin, and the lead portions have supplemental portions, respectively each having a shape which can be deformed and restored repeatedly in response to stress applied to the lead portions.

Now referring to the drawings, a detailed explanation will be given of various embodiments of this invention. A speaker apparatus 10 as illustrated in FIG. 3 will be explained as the first embodiment of this invention.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Embodiment 1

Figure 1:
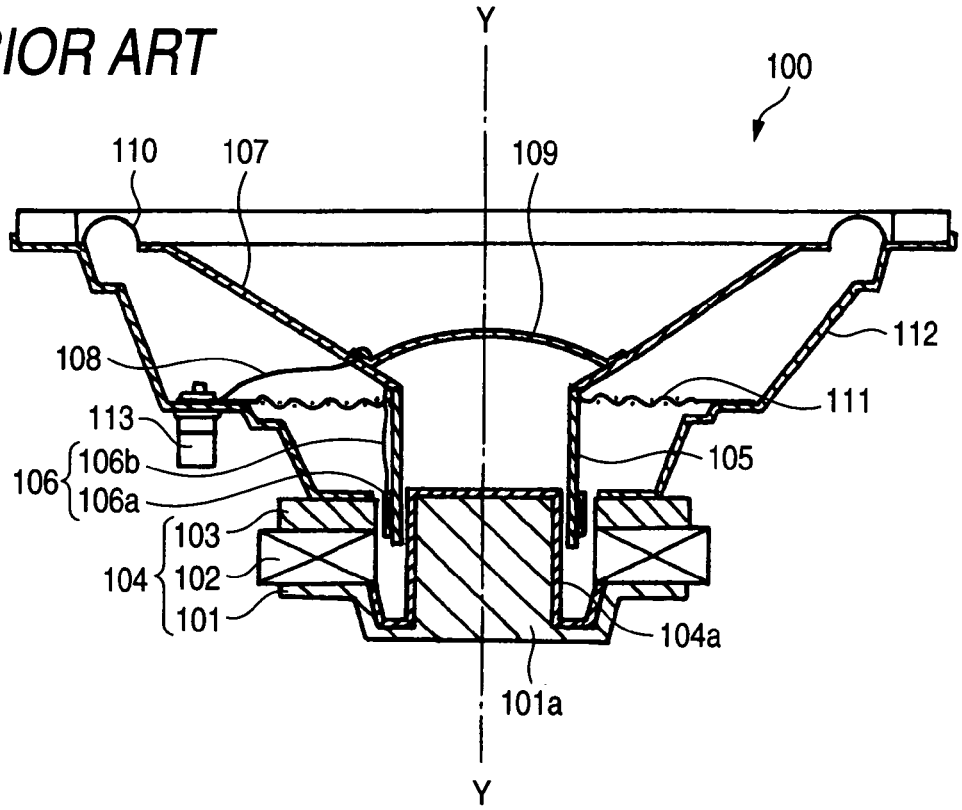
FIG. 1 PRIOR ART
FIG. 1 is a schematic sectional view of a prior art speaker apparatus.
Figure 2:
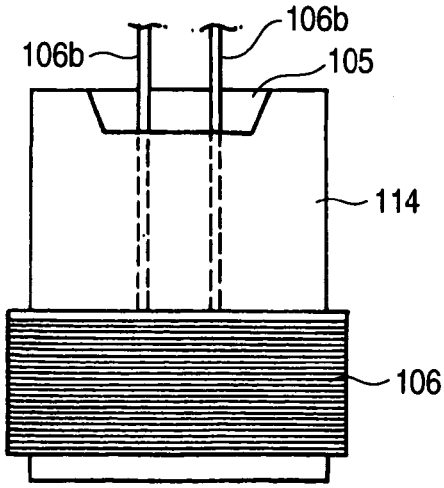
FIG. 2 PRIOR ART
FIG. 2 is a front view of a coil bobbin provided for the prior art speaker apparatus.
Figure 3:
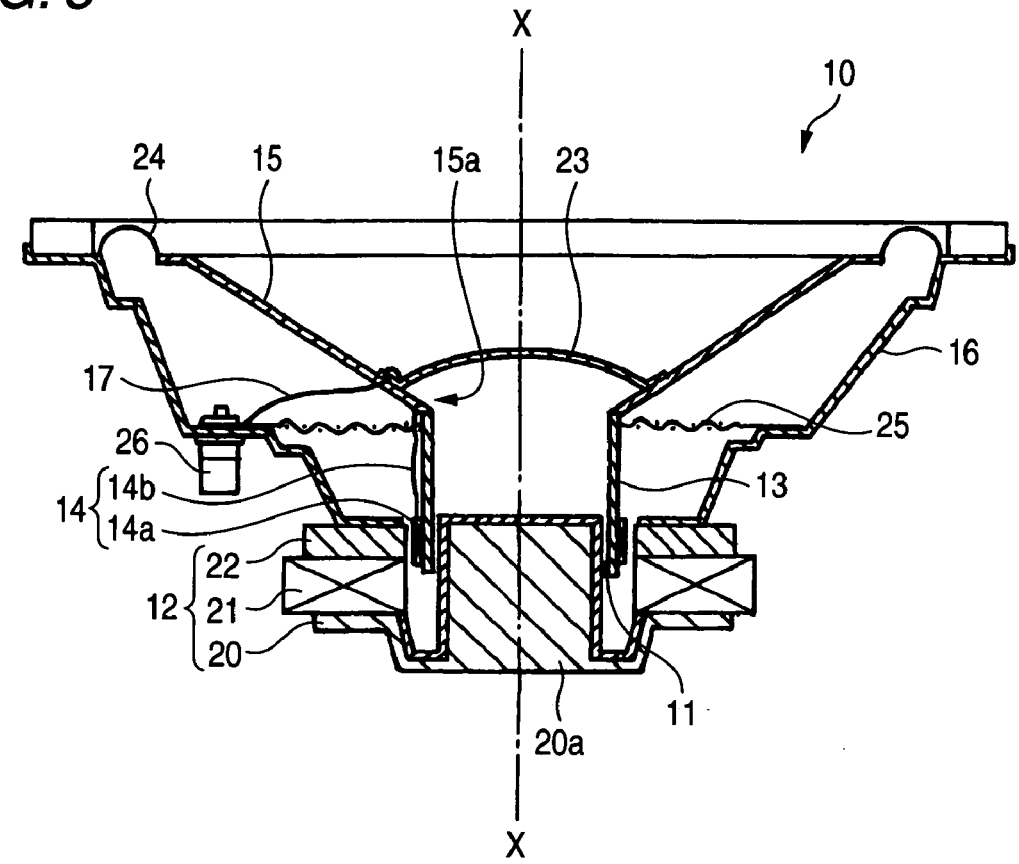
FIG. 3 is a schematic sectional view of the speaker apparatus according to a first embodiment of this invention.

As seen from FIG. 3, the speaker 10 according to the first embodiment includes a magnetic circuit 12 having a magnetic gap 11, a cylindrical coil bobbin 13 arranged within the magnetic gap 11, a voice coil 14 attached to the coil bobbin 13, a diaphragm 15 connected to the one end of the voice coil 14 and made oscillatable in an axial direction of the coil bobbin 13 (direction of X—X line in FIG. 3), and a frame 16 serving as a supporting body for supporting these components.

The magnetic circuit 12 includes a first yoke 20 which is disk-shaped and made of a soft-magnetic material such as soft iron with excellent conductivity, a ring-shaped magnet 21 arranged coaxially on the first yoke 20 and a second ring-shaped yoke 22 which is disk-shaped and arranged above the magnet 21.

The first yoke 20 is provided with a cylindrical center pole 20*a* provided upright from the center portion of the main surface of the bottom of the magnetic circuit 12. The center pole 20*a* may be formed integrally to the first yoke 20 or may be formed as a separate body of the same material as that of the first yoke 20.

The magnet 21 has a predetermined thickness and is made of e.g. ferrite magnet or a rare-earth magnet (permanent magnet) of neodymium metallic compound, samarium metallic compound, etc. The magnet 21 is arranged on the main surface of the bottom of the first yoke 20. The magnet 21 serves as a magnetic field generating portion for generating a magnetic field to be applied to the magnetic circuit and applies the magnetic field thus generated to the magnetic circuit 12 to make a magnetic flux loop.

Further, the material, shape, size, etc. of the magnet 21 are set so that the magnetic flux density within the magnetic gap 11 formed in the magnetic circuit 12 provides a desired value.

Incidentally, in the first embodiment, the ring-shaped magnet 21 of the speaker apparatus 10 is arranged in the magnetic flux loop formed in the magnetic circuit 12. However, the magnetic circuit of the speaker apparatus 10 may be formed with only a yoke made of a magnetic material so that the permanent magnet or electromagnet arranged outside the magnetic circuit applies a magnetic field into the magnetic circuit.

Concretely, the coil arranged e.g. on the periphery of the yoke may be supplied with a current so that the magnetic field generated from the coil forms the magnetic flux loop within the magnetic circuit.

The second yoke 22 is formed as a ring-shaped disk member made of the same material as or similar material to that of the first yoke 20. The second yoke 22 is arranged on the main surface of the magnet 21 on the side opposite to the side in contact with the first yoke 20. The inner diameter of the second yoke 22 is set so that its inner peripheral surface is opposite to and apart by a prescribed distance from the outer peripheral surface of the center pole 20*a*. In the magnetic circuit 12, a magnetic gap 11 from which the magnetic loop leaks out is formed in the gap formed between the inner peripheral surface of the second yoke 22 and the center pole 20*a*.

On the other hand, the coil bobbin 13 is made of a non-magnetic material such as paper, which is relatively light so as to provide a cylindrical-shaped member with prescribed rigidity. The one end of the coil bobbin 13 is attached to the voice coil 14 whereas the other end of the coil bobbin 13 is attached to the diaphragm 15.

Further, the coil bobbin 13 is located at the one end attached to the voice coil 14 so as to be inserted into the magnetic gap 11, and oscillatable in the axial direction (in the direction of X—X line in FIG. 3).

Figure 4:
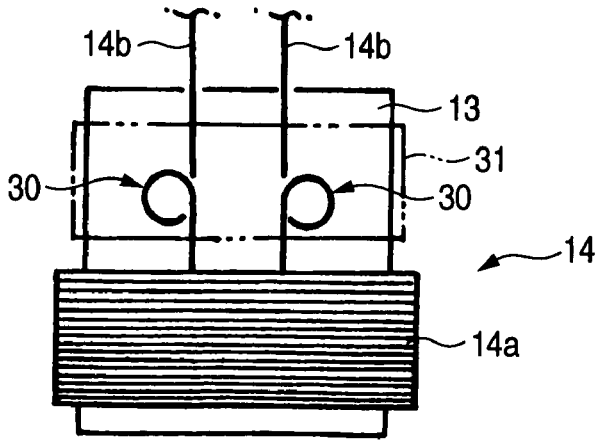
FIG. 4 is a front view of the state where a voice coil is attached to the coil bobbin provided for the speaker apparatus according to the first embodiment.
Figure 5:
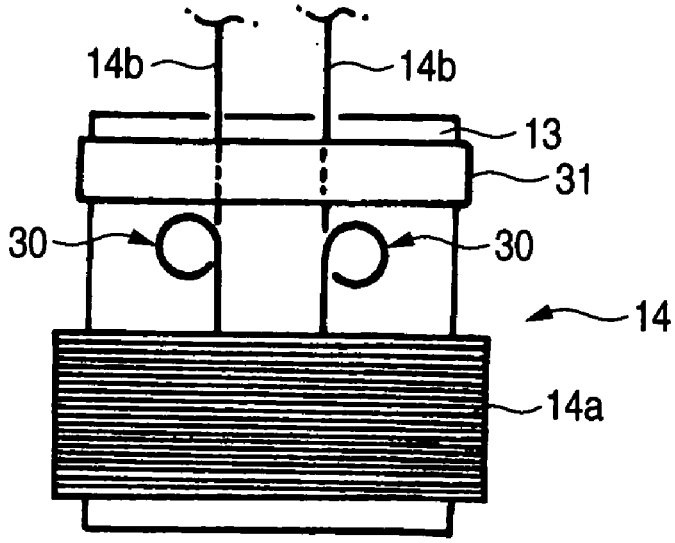
FIG. 5 is a front view for explaining another location example of an adhesive tape wound around the coil bobbin provided for the speaker apparatus according to the first embodiment.

FIG. 4 is a side view of the coil bobbin 13 provided with the voice coil 14.

As seen from FIG. 4, the voice coil 14 includes a winding portion 14*a* where a conductive wire is wound on the outer peripheral surface of the coil bobbin 13 and lead portions 14*b* where the conductive wires at each of both ends of the winding portion 14*a* is extracted along the outer peripheral surface of the coil bobbin in a direction of attaching the diaphragm 15.

Incidentally, in the first embodiment, the winding portion 14*a* and the lead portions 14*b* are provided on the outer peripheral surface of the coil bobbin 13. However, at least one of them may be provided on the inner peripheral surface of the coil bobbin 13.

Each of the lead portions 14*b* has a ring-shaped supplemental portion 30 formed by twisting the conductive wire by a prescribed angle so as to loop once. The provision of the supplemental portion 30 in the speaker apparatus 10 serves to buffer the stress applied to the lead portion 14*b*, thereby preventing the conductive wire in the lead portion 14*b* from breaking. The supplemental portion 30 will be described in detail later.

At the position where the supplemental portion 30 is provided, an adhesive tape 31, which is made of e.g. a belt-like molded paper material, is arranged. The adhesive tape 31 is wound on the lead portions 14*b* around the outer peripheral surface of the coil bobbin 13. The adhesive tape 31 serves to fix the lead portions 14*b* to the coil bobbin 13.

Incidentally, in FIG. 4, the adhesive tape 31 is illustrated in dotted line. Actually, it is wound on the lead portions 14*b* at the location where the supplemental portions 30 are provided so that the supplemental portions 30 are located inside the adhesive tape 31.

In the speaker apparatus 10, the lead portions 14*b* are fixed to the coil bobbin 13 by the adhesive tape 31. For this reason, even when the diaphragm 15 is oscillated for outputting the voice, the diaphragm 15 can be prevented from being subjected to free oscillation. Thus, it is possible to prevent unusual sound due to the oscillation and deterioration due to the metallic fatigue from occurring.

The position where the adhesive tape 31 is wound should not be limited to location where the supplemental portions 30 are provided as shown in FIG. 4. The adhesive tape 31 may be wound on the lead portions 14*b* at the more upper side than the position where the supplemental portions 30 are provided, i.e. at the side closer to the diaphragm 15 than the position where the supplemental portions 30 is provided.

Incidentally, in the speaker apparatus 10 according to the first embodiment, the adhesive tape 31 is required to fix the lead portions 14*b*. However, in the case where it is not necessary to fix the lead portions 14*b* to the coil bobbin 13 e.g. where the distance from the winding portion 14*a* to the diaphragm 15 is sufficiently short, it can dispense with the adhesive tape 31.

Further, in the first embodiment, the lead portions 14*b* are fixed by winding the adhesive tape 31. However, the member or manner of fixing the lead portions 14*b* to the coil bobbin 13 should not be particularly limited. For example, a pair of the lead portions 14*b* may be fixed individually by tape-like paper or fixed using adhesive.

Further, as shown in FIG. 3, the lead portion 14*b* is extracted to the main surface of the diaphragm 15. At the extracted position, the lead portion 14*b* is electrically connected to an electric supply line 17.

The electric supply line 17 is made of a conductive member having a larger diameter than the conductive wire, which constitutes the voice coil 14. The feeder 17 has a mechanical property enough to withstand deterioration or breaking even when the diaphragm 15 oscillates.

The diaphragm 15 is formed as a conical-shaped member made of the material having a predetermined rigidity. The diaphragm 15 has a center hole 15*a* formed at the central portion so as to have an aperture diameter equal to that of the diameter of the coil bobbin 13.

Further, the center hole 15*a* is covered with a cap 23 attached to the diaphragm 15. The one end of the diaphragm 15 on the side where the center hole 15*a* is provided is coupled with the one end of the coil bobbin 13 by e.g. adhesive.

Incidentally, the material and shape of the diaphragm 15 may be optionally selected as long as a prescribed rigidity is assured. For example, according to a desired output sound volume, output sound range, or output sound quality, the aperture diameter, shape or material of the diaphragm 15 may be selected.

The frame 16 is made of the material having excellent thermal conductivity. The frame 16 is attached to the main surface of the second yoke 22 comprising the magnetic circuit 12 on the side facing the outside. The frame 16 serves as a supporting body for supporting the components described above.

The frame 16 is provided to a pair of input terminals 26 (only one thereof is illustrated) for supplying a driving current to the voice coil 14. These pair of input terminals 26 each is connected to the other end of the electric supply line 17 connected to the lead portion 14*b*.

Meanwhile, as seen from FIG. 3, the coil bobbin 14 and diaphragm 15 are connected to the frame 16 through edges 24 and dampers 25 and elastically supported by these edges 24 and dampers 25. Thus, in the speaker apparatus 10 having the configuration described above, the coil bobbin 14, diaphragm 15 and winding portion 14*a* of the voice coil 14 attached to the coil bobbin 14 are made oscillatable in their integral state in the axial direction of the coil bobbin 13.

Namely, the speaker apparatus 10 according to the first embodiment is configured as a speaker apparatus in a "moving-coil system" in which the winding portion 14*a* of the voice coil 14 oscillates together with the diaphragm 15.

In the speaker apparatus 10 having the configuration described above, when a driving current is supplied to the voice coil 14 through the input terminal 26, the winding portion 14*a* of the voice coil 14 oscillates in an axial direction of the coil bobbin 13 (in the direction of X—X line in FIG. 3) owing to the electromagnetic force which is generated between itself and the magnetic field applied by the magnetic circuit 12. At this time, the diaphragm 15 also oscillates owing to the oscillation of the winding portion 14*a*, thus outputting an acoustic energy (voice) according to the supplied driving current.

Meanwhile, the speaker apparatus 10 exhibits the phenomenon that with an increase in the driving current supplied to the winding portion 14*a* of the voice coil 14, the influence of Lorentz force exerted on the winding portion 14*a* becomes conspicuous so that the tensile stress or compressive stress generated in the winding portion 14*a* increases.

Thus, owing to the influence of the stress exerted on the winding portion 14*a*, the coil bobbin 13 at the portion on which the winding portion 14*a* is wound is subject to deformation or oscillation in a radial direction.

As a result, the deformation or oscillation of the coil bobbin 13 affects the lead portions 14*b* extracted along the outer peripheral surface of the coil bobbin 13. However, in the speaker apparatus 10, the supplemental portions 30 added to the lead portions 14*b* can buffer the stress exerted on the lead portions 14*b*.

Thus, in the speaker apparatus 10, when a larger driving current is supplied to the voice coil 14, even if the coil bobbin 13 is subject to the deformation or oscillation owing to that of the voice coil 14, the lead portions 14*b* are prevented from breaking.

Incidentally, the position where the supplemental portions 30 are provided is not particularly limited as long as they are added to the conductive wires (lead portions 14*b*) extracted from the winding portion 14*a*. However, for the reason described above, since the deformation or oscillation of the coil bobbin 13 is most conspicuous at the position where the winding portion 14*a* is attached, the supplemental portions 30 are preferably provided directly behind the position where the conductive wires are extracted from the winding portion 14*a*, i.e. at the position in close proximity to the periphery of the winding portion 14*a*.

Thus, the stress exerted on the lead portions 14*b* by the deformation or oscillation of the coil bobbin 13 can be buffered most effectively.

In the above explanation, the conductive wire at each of the lead portions 14*b* is twisted by a prescribed angle to loop once to make a ring-shape so that the supplemental portion 30 is made. However, the shape of the supplemental portion 30 is not particularly limited as long as the shape of the lead wire is restorable repeatedly in response to the stress exerted on the lead portion 14*b*.

Concretely, for example, the conductive wire at the lead portion 14*b* may be looped at plural times to make a "coil-shape", thereby providing the supplemental portion 30.

Further, as seen from FIG. 4, the conductive wire at the lead portion 14*b* may be bent twice in opposite directions to make a "S-shape", thereby providing the supplemental portion 30.

Figure 6:
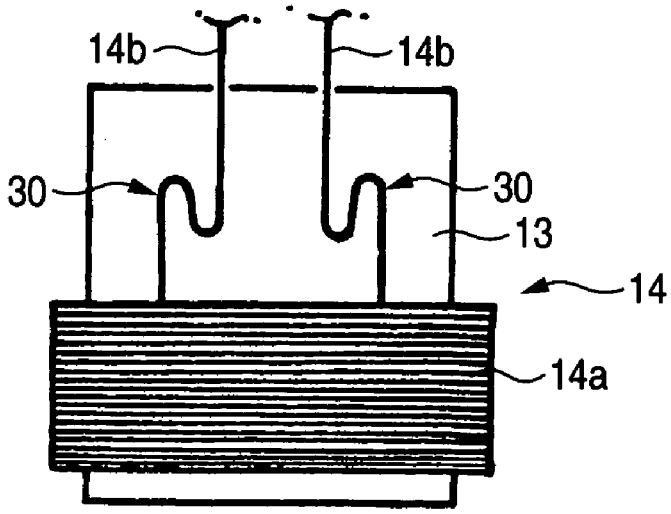
FIG. 6 is a front view for explaining a modification of supplemental portions for the coil bobbin provided for the speaker apparatus according to the first embodiment.

Further, the configuration shown in FIG. 6 may be developed. Specifically, the conductive wire at the lead portion 14*b* may be bent in opposite directions at plural times to make a continuous sinusoidal shape, thereby providing the supplemental portion 30. It should be noted that the adhesive tape 31 is not shown.

As described above, the supplemental portion 30 is provided by forming the conductive wire in a regular shape such as a ring-shape, coil-shape, S-shape, sinusoidal shape, etc. For this reason, when the stress is exerted on the lead portion 14*b*, the lead portion 14*b* can deform at the position of the supplemental portion 30 so as to buffer the stress. In addition, when the stress is removed, the lead portion 14*b* can be restored in the original shape.

Further, by making the supplemental portion 30 in the regular shape, its shape can be deformed or restored repeatedly. This makes it possible to keep the prevention of the breaking of the lead portion 14*b* for a long time.

Incidentally, the shape of the supplemental portion 30 is not limited as described above. However, as shown in FIG. 4, the conductive wire at the lead portion 14*b* is preferably twisted by a prescribed angle to loop once to make a ring shape. This makes it possible to simplify the operation of shaping the conductive wire at the position of the supplemental portion 30, thereby minimizing the operation of forming the supplemental portion 30.

As understood from the description hitherto made, the speaker apparatus 10 is provided with the supplemental portions 30 at the lead portions 14*b* so that it can prevent the lead portions 14*b* from breaking effectively, thereby providing high reliability.

Thus, the speaker apparatus 10 can be employed as a high output apparatus, which can make a voice output surely, and stably in response to the large driving current.

Accordingly, the speaker apparatus 10 is preferably applied to a woofer for reproducing a bass range sound or sub-woofer to which a larger driving current is supplied than in speaker apparatuses for use in a squawker for reproducing a mid-range sound and in a tweeter for reproducing a treble range sound.

Further, in the speaker apparatus 10, the breaking of the lead portions 14*b* is prevented only by forming the conductive wires at the lead portions 14*b* in a prescribed shape.

Therefore, unlike the techniques conventionally proposed for preventing the breaking of the conductive wire, it is not necessary to attach additional members such as the streamlined wire, sealing member, caulking metal fitting, etc. As a result, it can dispense with the cost required for these members and the production process is not complicated, thereby avoiding an increase in the production cost of the speaker apparatus.

Further, in the speaker apparatus 10, it is not necessary to attach the additional member for preventing the wire breaking at the lead portions 14*b* so that the weight of the portion oscillating together with the diaphragm 15 will not be increased. Thus, the speaker apparatus 10 can be constituted as a speaker apparatus, which is free from deterioration of sound quality and attenuation of the output efficiency and can provide high sound quality and high efficiency.

Further, in the speaker apparatus 10, the supplemental portions 30 can surely prevent the wire breaking at the lead portions 14*b* so that the diameter of the conductive wire constituting the voice coil 14 can be sufficiently reduced. This reduces the volume and weight of the voice coil 14 to contribute to reduction in size and weight of the whole speaker apparatus.

Thus, the speaker apparatus 10 can be very preferably employed for the uses in which the space for mounting is limited, reduction in weight is highly required and high output is required, i.e. uses of e.g. vehicle-mounted woofer or sub-woofer.

Embodiment 2

Figure 7:
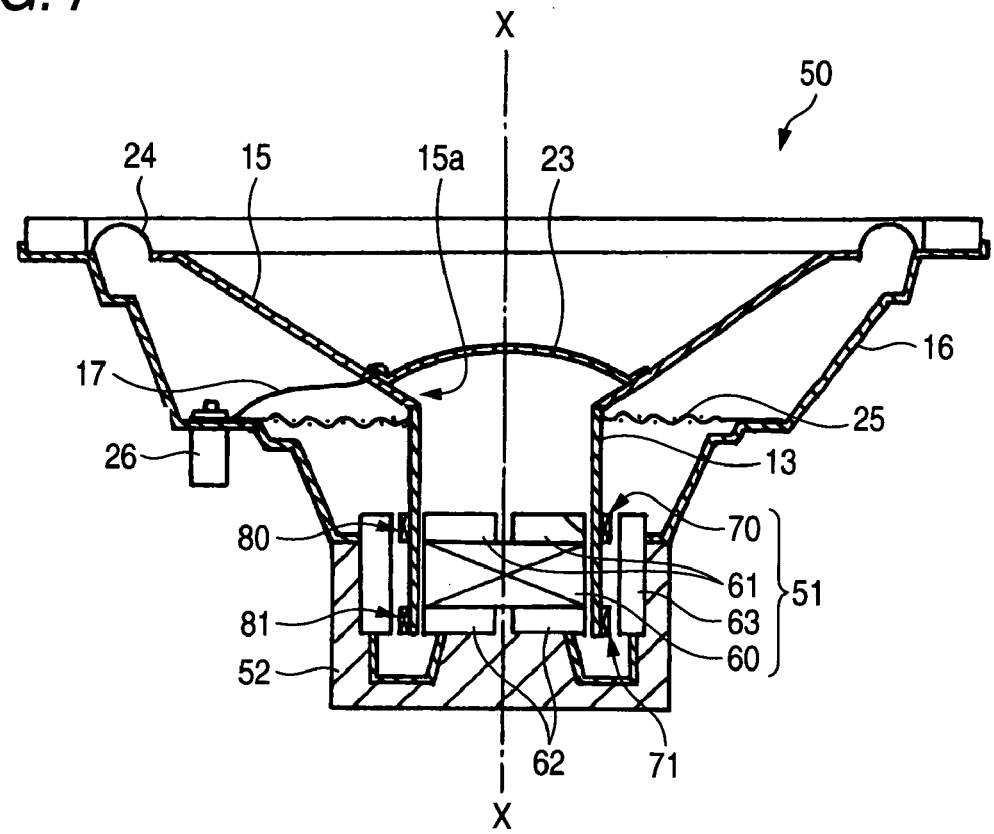
FIG. 7 is a schematic sectional view of the speaker apparatus according to a second embodiment of this invention.

An explanation will be given of a speaker apparatus 50 as shown in FIG. 7, which is the second embodiment of this invention.

The speaker apparatus 50 has the same or similar configuration as that of the speaker apparatus 10, which has been explained as the first embodiment except that the speaker apparatus 50 is equipped with two magnetic gaps and two voice coils.

Therefore, in the following explanation, only the difference of the speaker apparatus 50 from the speaker apparatus 10 according to the first embodiment will be explained. Like reference numerals in the speaker apparatus 50, which refer to like elements or portions in the speaker apparatus 10, will not be explained here.

As seen from FIG. 7, the speaker apparatus 50, in addition to the same configuration as that of the speaker apparatus 10, includes a magnetic circuit 51 corresponding to the magnetic circuit 12 of the speaker apparatus 10 and a supporting portion 52 for supporting the magnetic circuit 51.

The supporting portion 52 is formed in such a shape as to support the magnetic circuit 51 from the bottom side using a non-magnetic material. A frame 16 is attached to the one end of the supporting portion 52. The supporting portion 52 may be formed integrally to the frame 16.

The magnetic circuit 51 includes a cylindrical magnet 60 arranged in a space formed inside the coil bobbin 13, a first yoke 61 and a second yoke 62 provided on both main surfaces of the magnet 60 respectively, and a third yoke 63 arranged on the outer periphery of the coil bobbin 13.

The magnet 60 is formed as a cylindrical member having a prescribed thickness. The magnet 60 is made of e.g. ferrite magnet or a rare-earth magnet (permanent magnet) of neodymium metallic compound, samarium metallic compound, etc. The magnet 60 is attached to the central portion of a supporting member 52 through the first yoke 61. The magnet 60 serves as a magnetic field generating portion, which generates a magnetic field to be applied to the magnetic circuit 51, and applies the magnetic field thus generated to form a magnetic flux loop.

The first yoke 61 and the second yoke 62 are formed as a ring-shaped disk member having a thickness equal to that of the magnet 60. These yokes 61 and 62 are made of a soft magnetic material such as soft iron with excellent thermal conductivity. The third yoke 63 is a cylindrical member made of the same material as that of the first yoke 61 and second yoke 62. The magnetic circuit 51 is arranged within the third yoke 63 in a state where the second yoke 62, magnet 60 and first yoke 61 are successively stacked, and is supported by the supporting portion 52 with the center axes of the respective members being coincident.

The third yoke 63 has an inner diameter set so that its inner peripheral surface is opposite to and apart by a predetermined distance from the outer peripheral surface of each of the first yoke 61 and the second yoke 62. The magnetic circuit 51 has a first magnetic gap 70 in the gap formed between the outer peripheral surface of the first yoke 61 and the third yoke 63, and a second magnetic gap 71 in the gap formed between the outer peripheral surface of the second yoke 62 and the third yoke 63.

Figure 8:
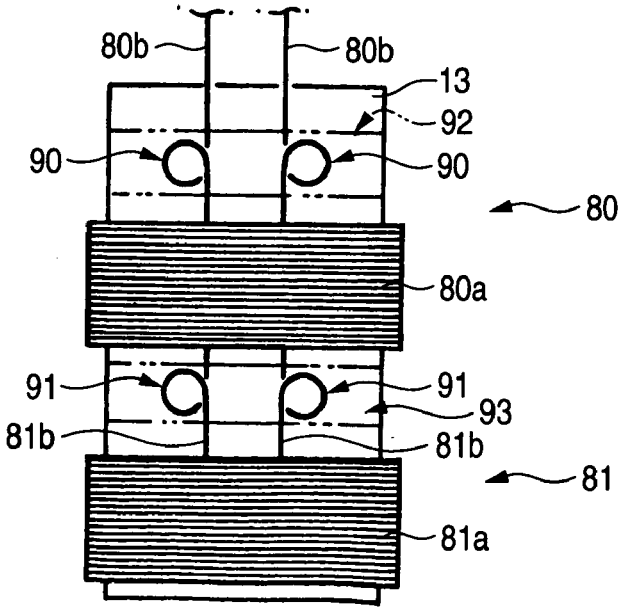
FIG. 8 is a front view of the state where a first voice coil and a second voice coil are attached to the coil bobbin provided for the speaker apparatus according to the second embodiment.

As seen from FIG. 8, the speaker apparatus 50 is provided with a first voice coil 80 and a second voice coil 81 which are attached to the outer peripheral surface of the coil bobbin 13.

The first voice coil 80 is provided so as to be located within the first magnetic gap 70 and the second voice coil 81 is provided so as to be located within the second magnetic gap 71. FIG. 8 is a side view of the coil bobbin 13 provided with the first voice coil 80 and the second voice coil 81.

The first voice coil 80 includes a first winding portion 80*a* where a conductive wire is wound on the outer peripheral surface of the coil bobbin 13 and first lead portions 80*b* where the conductive wires at both ends of the winding portion 80*a* extracted along the outer peripheral surface of the coil bobbin 13 in a direction of attaching the diaphragm 15.

The second voice coil 81 includes a second winding portion 81*a* where a conductive wire is wound on the outer peripheral surface of the coil bobbin 13 and second lead portions 81*b* where the conductive wires at both ends of the winding portion 81*a* extracted along the outer peripheral surface of the coil bobbin 13 in a direction of attaching the first voice coil 80. The second lead portions 81*b* are connected to the first winding portion 80*a* of the first voice coil 80.

Incidentally, in the speaker apparatus 50, the first voice coil 80 and second voice coil 81 may be formed with the same continuous conductive wire, or may be formed with their respective conductive wires, which are connected to each other.

It should be noted that when these voice coils are formed with the same conductive wire, the operation step of connecting the respective conductive wires to each other could be omitted so that the production cost can be reduced.

In addition, in this case, there is no fear of generating connection failure etc. at the portion where the conductive wires are connected so that the production yield and reliability of the product can be improved.

The first lead portions 80*b* and second lead portions 81*b* have first supplemental portions 90 and second supplemental portions 91, respectively, which correspond to the supplemental portions 30 explained in the first embodiment.

The first supplemental portions 90 and second supplemental portions 91 are formed to have the same configuration as that of the supplemental portions 30 and have the same function and effect as those of the supplemental portions 30. Therefore, their detailed explanation will not be made.

At the positions where the first lead portions 80*b* and second lead portions 81*b* are extracted, a first adhesive tape 92 and a second adhesive tape 93, which correspond to the adhesive tape 31 explained in the first embodiment, are arranged, respectively. These first adhesive tape 92 and second adhesive tape 93 are formed to have the same configuration as that of the adhesive tape 31 and have the same function and effect as those of the adhesive tape 31. Therefore, their detailed explanation will not be made.

Incidentally, in FIG. 8, the first adhesive tape 92 and second adhesive tape 93 are illustrated in dotted line. Actually, the first adhesive tape 92 and second adhesive tape 93 are wound on the first lead portions 80*b* and second lead portions 81*b*, respectively around the coil bobbin 13 so that these lead portions are partially located inside the first adhesive tape 92 and second adhesive tape 93, respectively.

The speaker apparatus 50 having the configuration as described above is provided with the first magnetic gap 70 and second magnetic gap 71, and the first voice coil 80 and second voice coil 81, i.e. has a structure in which the voice coils are given to the two magnetic gaps, respectively.

Such a structure of the speaker apparatus 50 permits the amplitude balance of the diaphragm 15 to be made uniform, thereby further improving the sound quality of the speaker apparatus.

For the same reason as that explained in connection with the first embodiment, in the speaker apparatus 50, when a large driving current is supplied, the coil bobbin 13 is subjected to deformation or oscillation in a radial direction at the portion where the first voice coil 80 and second voice coil 81 are provided. As a result, the deformation or oscillation of the coil bobbin 13 also affects the first and second lead portions 80*b* and 81*b* extracted along the outer peripheral surface of the coil bobbin 13. However, in the speaker apparatus 50, the first and second supplemental portions 90 and 91 added to the first and second lead portions 80*b* and 81*b*, respectively can buffer the stress exerted on the first and second lead portions 80*b* and 81*b*.

Specifically, the provision of the first supplemental portions 90 in the speaker apparatus 50 prevents the wire breaking at the first lead portions 80*b* in the same manner as in the speaker apparatus 10 in connection with the first embodiment.

Further, the provision of the second supplemental portions 91 in the speaker apparatus 50 prevents the wire breaking at the second lead portions 81*b* also which connect the first voice coil 80 and the second voice coil 81.

Thus, the speaker apparatus 50 not only permits the amplitude balance of the diaphragm 15 to be made uniform, thereby further improving the sound quality, but also facilitates accepting a high output and reduction in size and weight of the speaker apparatus.

Further, in order to prevent the wire breaking at the first lead portion 80*b* and second lead portions 81*b*, it is not necessary to attach additional members so that an increase in the production cost of the speaker apparatus can be avoided.

Although the first embodiment and second embodiment of this invention has been explained hitherto referring to the drawings, various modifications and changes can be made on the basis of the sprit of this invention in a range apparent to those skilled in the art.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable on skilled in the art to utilize the invention in various embodiments and with various modifications as are suited to the particular use contemplated. It is intended that the scope of the invention be defined by the claims appended hereto, and their equivalents.

What is claimed is:

1. A speaker apparatus comprising:

a magnetic circuit having a magnetic gap;

a magnet for generating a magnetic field to be applied to the magnetic circuit;

a cylindrical coil bobbin arranged within the magnetic gap;

a voice coil attached to the coil bobbin; and a diaphragm coupled with the one end of the coil bobbin and being oscillatable in an axial direction of the coil bobbin, wherein the voice coil includes a winding portion where a conductive wire is wound in a circumferential direction on the periphery of the coil bobbin, lead portions where the conductive wire at each of both ends of the winding portion is extracted along a bus line of the outer peripheral surface of the coil bobbin, and supplemental portions added to the lead portions, and the supplemental portions each has a shape, which can be deformed and restored repeatedly in response to stress, applied to the lead portions when the diaphragm oscillates.

2. A speaker apparatus according to claim 1, wherein each the supplemental portions is provided by making the conductive wire in a regular shape.

3. A speaker apparatus according to claim 2, wherein each the supplemental portions is provided by making the conductive wire in a ring shape.

4. A speaker apparatus according to claim 1, further comprising a fixing member for fixing the lead portions on the periphery of the coil bobbin.

5. A speaker apparatus according to claim 4, wherein the fixing member is an adhesive tape wound around the coil bobbin.

6. A speaker apparatus according to claim 1, wherein the magnetic circuit includes a first magnetic gap and a second magnetic gap, the voice coil is arranged within the first magnetic gap, a second voice coil is arranged within the second magnetic gap to include a second winding portion where a second conductive wire is wound on the periphery of the coil bobbin, second lead portions where the second conductive wire at each of both ends of the second winding portion is extracted unidirectionally along the periphery of the coil bobbin, the second lead portions being connected to the conductive wire of the voice coil, and the second lead portions have second supplemental portions each having a shape, which can be deformed and restored repeatedly in response to stress applied to the second lead portions.

* * * * *